US009635949B2

(12) United States Patent
Nomura et al.

(10) Patent No.: US 9,635,949 B2
(45) Date of Patent: May 2, 2017

(54) BOTTOM FOR BED APPARATUS

(71) Applicant: PARAMOUNT BED CO., LTD., Tokyo (JP)

(72) Inventors: Katsuyoshi Nomura, Tokyo (JP); Yuji Nakano, Tokyo (JP); Tatsuya Shimada, Tokyo (JP); Eita Hirai, Tokyo (JP); Takeshi Yanagihara, Tokyo (JP); Takaki Matsumoto, Tokyo (JP); Dan Kageyama, Tokyo (JP); Shinnosuke Kubota, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 0 days.

(21) Appl. No.: 14/782,375

(22) PCT Filed: Mar. 19, 2014

(86) PCT No.: PCT/JP2014/057586
§ 371 (c)(1),
(2) Date: Oct. 5, 2015

(87) PCT Pub. No.: WO2014/171254
PCT Pub. Date: Oct. 23, 2014

(65) Prior Publication Data

US 2016/0029807 A1 Feb. 4, 2016

(30) Foreign Application Priority Data

Apr. 19, 2013 (JP) ..... 2013-088383

(51) Int. Cl.
*A61G 7/002* (2006.01)
*A47C 20/04* (2006.01)
(Continued)

(52) U.S. Cl.
CPC ..... *A47C 20/04* (2013.01); *A47C 19/025* (2013.01); *A47C 19/04* (2013.01); *A61G 7/015* (2013.01)

(58) Field of Classification Search
CPC ..... A61G 7/002
(Continued)

(56) References Cited

U.S. PATENT DOCUMENTS 5,469,591 A * 11/1995 Nomura ..... A47C 20/04 5/191
6,389,622 B1 * 5/2002 Her ..... A61G 7/002 5/425
(Continued)

FOREIGN PATENT DOCUMENTS

EP 0 558 108 A2 9/1993
EP 2 987 475 A1 2/2016
(Continued)

OTHER PUBLICATIONS

International Search Report for corresponding International Application No. PCT/JP2014/057586 mailed Jun. 24, 2014.
(Continued)

*Primary Examiner* — Fredrick Conley
(74) *Attorney, Agent, or Firm* — Renner, Otto, Boisselle & Sklar, LLP

(57) ABSTRACT

To provide a bottom for a bed apparatus that can make the user feel comfortable when lying on the bed apparatus. The bottom for a bed apparatus, which is height adjustable and is mounted on the top of a bed apparatus, comprising a plurality of parts each formed of a resin plate having a thickness, including a back bottom, a hip bottom, a knee bottom and a foot bottom. Of the parts, essential parts are joined by connecting parts, and the connecting parts are formed of the same material with, to be thinner than, and
(Continued)

integrally with, the essential parts, and, depressed portions are formed on the top surface of the bottom around the center in the width direction of the bottom, and a plurality of passage holes are perforated in the depressed portions from the top surface to the undersurface of the bottom.

7 Claims, 5 Drawing Sheets

(51) Int. Cl.
*A61G 7/015* (2006.01)
*A47C 19/02* (2006.01)
*A47C 19/04* (2006.01)

(58) Field of Classification Search
USPC ..... 5/613–618, 188, 191
See application file for complete search history.

(56) References Cited

U.S. PATENT DOCUMENTS

| | | | |
|---|---|---|---|
| 7,036,166 | B2 | 5/2006 | Kramer et al. |
| 7,610,638 | B2 | 11/2009 | Kramer et al. |
| 2002/0174487 | A1 | 11/2002 | Kramer et al. |
| 2006/0143829 | A1 | 7/2006 | Kramer et al. |

FOREIGN PATENT DOCUMENTS

| | | | |
|---|---|---|---|
| GB | 2 362 566 | A | 11/2001 |
| JP | 04-352908 | | 12/1992 |
| JP | 2002-102294 | | 4/2002 |
| JP | 2005-509450 | A | 4/2005 |
| JP | 2006-198352 | | 8/2006 |
| JP | 2010-194065 | | 9/2010 |
| WO | WO 2007/010213 | A2 | 1/2007 |
| WO | WO 2011/161930 | A1 | 12/2011 |

OTHER PUBLICATIONS

International Preliminary Report on Patentability for corresponding International Application No. PCT/JP2014/057586 dated Oct. 20, 2015 (English translation).
Extended European Search Report dated Oct. 19, 2016 for corresponding European Application No. 14785015.0.

* cited by examiner (a)

(b)

(a)

(b)

BOTTOM FOR BED APPARATUS

TECHNICAL FIELD

The present invention relates to a bottom for a bed apparatus on which a mattress will not slip when the bottom is positioned flat or aslant.

BACKGROUND ART

In a bed apparatus, the bottom on which a mattress is placed is formed of approximately rectangular, molded metallic plates being arrayed in the longitudinal direction of the bed apparatus. In order to support back-raising and foot-raising operations, the bottom is composed of the aforementioned rectangular plates with their short side arranged in the length direction of the bed apparatus (see Japanese Patent Application Laid-open 2006-198352 (Patent Document 1)).

In the bed apparatus of this kind, a plurality of plates are joined and placed on the bed frame. Because the joined plates flex in back-raising and/or leg-raising operations, the plates need to be arranged with gaps therebetween.

However, there is a fear that the gaps between plates causes the user to feel a jagged sensation. Though the user's feel of a bed can be bettered by the mattress, there has been no proposal of the bottom that can prevent this jagged sensation.

Further, as a structure for preventing the mattress from slipping sidewards over the bottom, in Patent Document 1, a pair of anti-sideslip members are arranged along both sides of the bottom. The anti-sideslip members engage the edges of the mattress to prevent slip.

PRIOR ART DOCUMENTS

Patent Documents

Patent Document 1:
Japanese Patent Application Laid-open 2006-198352

SUMMARY OF THE INVENTION

Problems to be Solved by the Invention

In view of the above circumstances, it is an object of the present invention to provide a bottom for a bed apparatus that can make the user feel comfortable when lying on the bed apparatus.

Means for Solving the Problems

According to the present invention, a bottom for a bed apparatus, which is height adjustable and is mounted on the top of a bed apparatus, comprising: a plurality of parts each formed of a resin plate having a thickness, including a back bottom, a hip bottom, a knee bottom and a foot bottom, wherein essential parts among the plurality of parts are joined by connecting parts, and the connecting parts are formed of the same material with, to be thinner than, and integrally with, the essential parts, and, depressed portions are formed on the top surface of the bottom, the depressed portions are formed in the central part of the bottom with respect to the width direction, and a plurality of passage holes are formed from the top surface to the undersurface of the bottom in the depressed portions.

In the present invention, it is preferable that, the depressed portions are formed in dimensions corresponding to the width of the user body, leaving surrounding areas in the head side, the foot side, and both sides in the width direction, of the entire bottom.

In the present invention, it is also preferable that, the depressed portions of the bottom are formed so that the depressed portions of the hip bottom is the deepest, and the depressed portions of the knee bottom is the second deepest.

In the present invention, it is preferable that, the essential parts of the bottom are the hip bottom, knee bottom and foot bottom, a flexing part is extended from the hip bottom, overlapping the back bottom, and flexibly joined to the back bottom so as to slide along the back bottom when a back-raising operation is carried out.

Effect of the Invention

According to the bottom of the bed apparatus of the present invention, the bottom includes the plurality of parts each formed of a resin plate having a thickness, including a back bottom, a hip bottom, a knee bottom and a foot bottom, and the essential parts among the plurality of parts are joined by connecting parts, and the connecting parts are formed of the same material with, thinner than, and integrally with, the essential parts. Accordingly, the user who is lying in the bed will not sink in at each connecting part and will not feel a bumpy sensation that would occur when part of the mattress is closed in.

Further, since the depressed portions are formed in the central part of the bottom with respect to the width direction, the pressure against the body at points of contact when the user lies on the bed apparatus is alleviated compared to the case of a flat surface. In addition, it is possible to assure the breathability of the bottom by provision of passage holes.

As a result, it is possible to provide excellent effect of making the user feel a comfortable sensation in lying.

MODE FOR CARRYING OUT THE INVENTION

Now, an embodiment of the present invention will be described with reference to the accompanying drawings.

Figure 1:
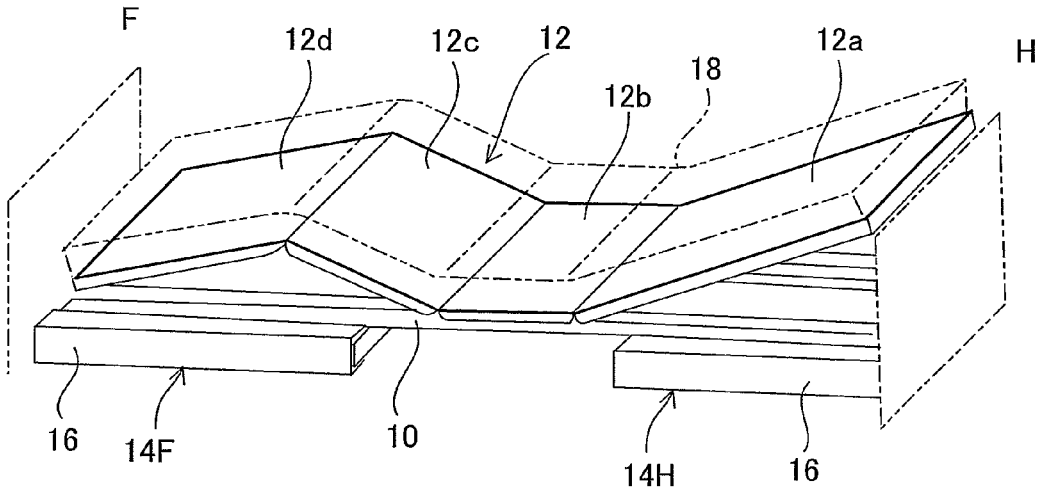
FIG. 1 (a) A schematic perspective view of a bed apparatus on which a bottom according to an embodiment of the present invention is mounted, and (b) a perspective view of the bottom.
Figure 1:
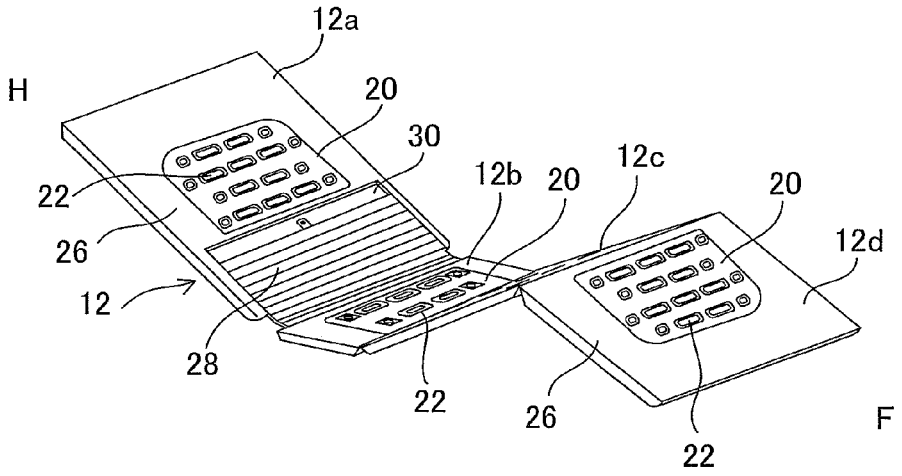

FIG. 1(*a*) is an overall perspective view of a bed apparatus on which a bottom according to the present invention is mounted, (b) is a perspective view of the bottom, and FIGS. 2 to 5 are illustrative views of the bottom.

Figure 2:
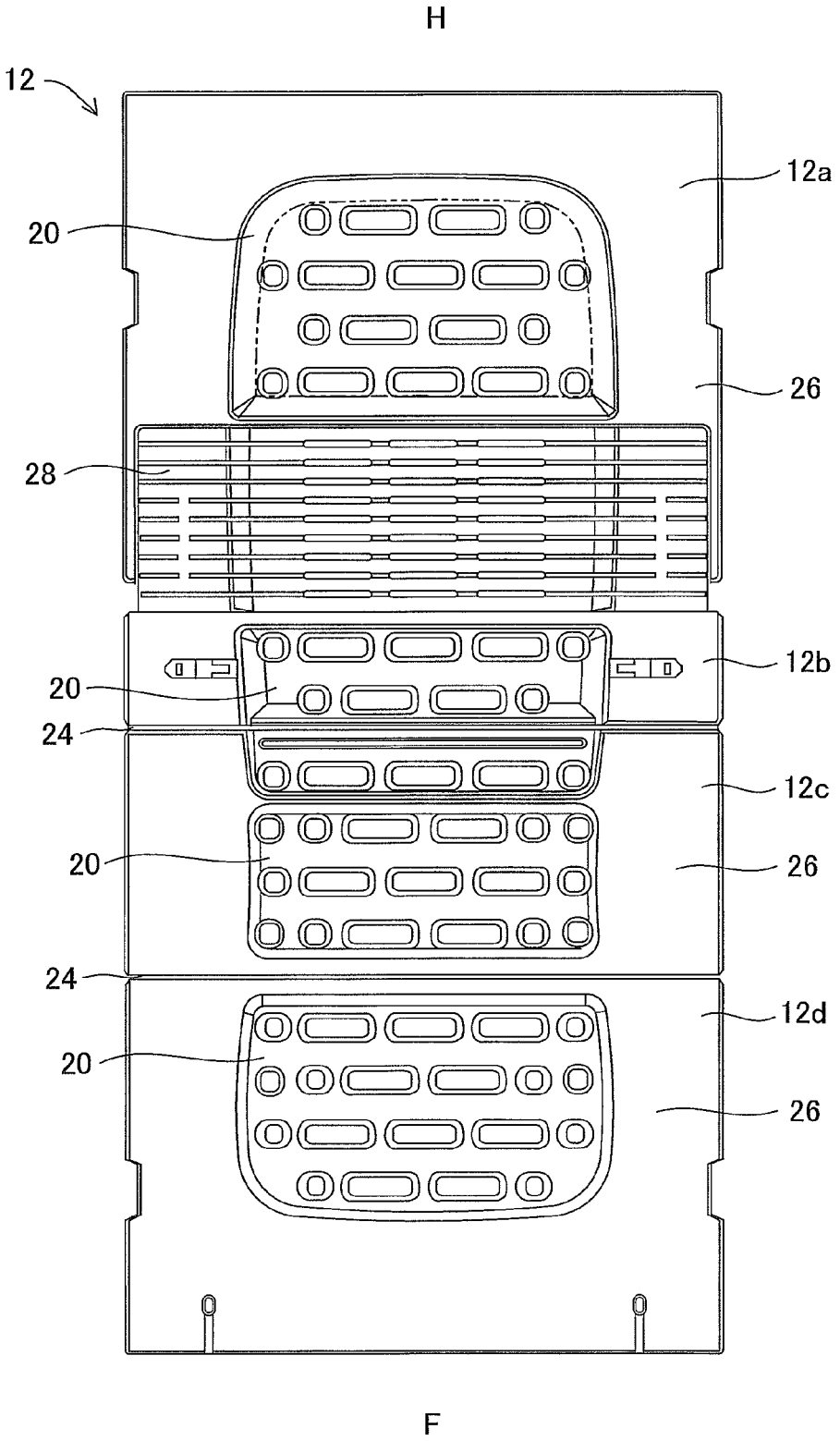
FIG. 2 An overall plan view of a bottom.

As shown in FIGS. 1 and 2, in the bed apparatus, the head side to which the head of the user is oriented when lying is indicated by "H" and the foot side to which the user's feet are oriented is indicated by "F".

As shown in FIG. 1(*a*), the bed apparatus includes: a top frame 10 having an approximate ladder structure with its length oriented along the direction from the head side to the foot side; a bottom 12 placed on the top frame 10; and a head-side lift 14H and a foot-side lift 14F that are arranged on the head and foot sides under the top frame 10, respectively, to support the top frame 10 so as to be raised and lowered relative to the floor.

Approximately rectangular support frames 16, longer in the width direction of the bed apparatus, on which the top frame 10 is set, are arranged on the head and foot sides under the top frame 10, and fixed to the top ends of the head-side lift 14H and foot-side lift 14F, respectively.

Though not illustrated, the lifts 14H and 14F are detachably joined at their lower ends by means of a connecting frame. Each of the lifts 14H and 14F is provided with an actuator so that the drive force of each actuator can be controlled separately. The top frame 10 is hence possible to perform a tilting operation for make level difference between the head side and the foot side by controlling drive of each actuator.

Further, in the top frame, a back-raising rod and a knee-raising rod are provided on the head side and in the center area, respectively. Actuators for driving these are also provided.

As shown in FIGS. 1 and 2, the bottom 12 supports the weight of the user with a mattress (schematically shown by a reference numeral '18' in FIG. 1) placed thereon. The bottom 12 is composed of multiple plates, specifically, a back bottom 12*a* for supporting the head and back of the user, a hip bottom 12*b* for supporting the hips, a knee bottom 12*c* for supporting part from hips to knees and a foot bottom 12*d* for supporting part from knees to toes.

In the bed apparatus of the embodiment, the bottom 12 arranged on the top is height adjustable. That is, the back bottom 12*a* of the bottom 12 is configured to enable back-raising operation by means of the back-raising rod, and the knee bottom 12*c* and foot bottom 12*d* are configured to enable knee-raising operation and foot-raising operation by means of the knee-raising rod.

Herein, in the bottom 12, each of the back bottom 12*a*, hip bottom 12*b*, knee bottom 12*c* and foot bottom 12*d*, is formed of a resin plate having a thickness and formed with a depressed portion 20 on the top surface of each, as will be described in detail.

In the depressed portion 20, a plurality of passage holes 22 are perforated from the top surface to the undersurface of bottom 12. These multiple passage holes 22 are arrayed in the width and length directions of the bottom 12. The passage holes 22 may be provided in any form and in any number as appropriate. In the embodiment the passage holes 22 are formed such that a plurality of circular and rectangular (the long side oriented in the width direction) holes are arrayed in line and these lines are arranged in parallel in the longitudinal direction of the bottom 12, as shown in FIG. 2.

The depressed portions 20 are hollowed on the top surface of the bottom 12. The depressed portions 20 are formed in the central part of the bottom 12 with respect to the width direction. Specifically, in the bottom 12, depressed portions 20 are formed contiguously in the back bottom 12*a*, hip bottom 12*b*, knee bottom 12*c* and foot bottom 12*d*. The depressed portions 20 are formed on the top surface of bottom 12, leaving surrounding part of the bottom 12 as a whole.

That is, the depressed portions 20 are formed leaving flat surrounding areas 26 in the head side end of the back bottom 12*a*, both sides of the back bottom 12*a*, hip bottom 12*b*, knee bottom 12*c* and foot bottom 12*d* and the foot side end of the foot bottom 12*d*. In other words, the depressed portions 20 are formed in the interior part surrounded by the flat surrounding areas 26. The depressed portions 20 are suitably formed with a width ranging from one half to four fifths of the width of the bottom 12 though the bottom width can be determined as appropriate.

Figure 4:
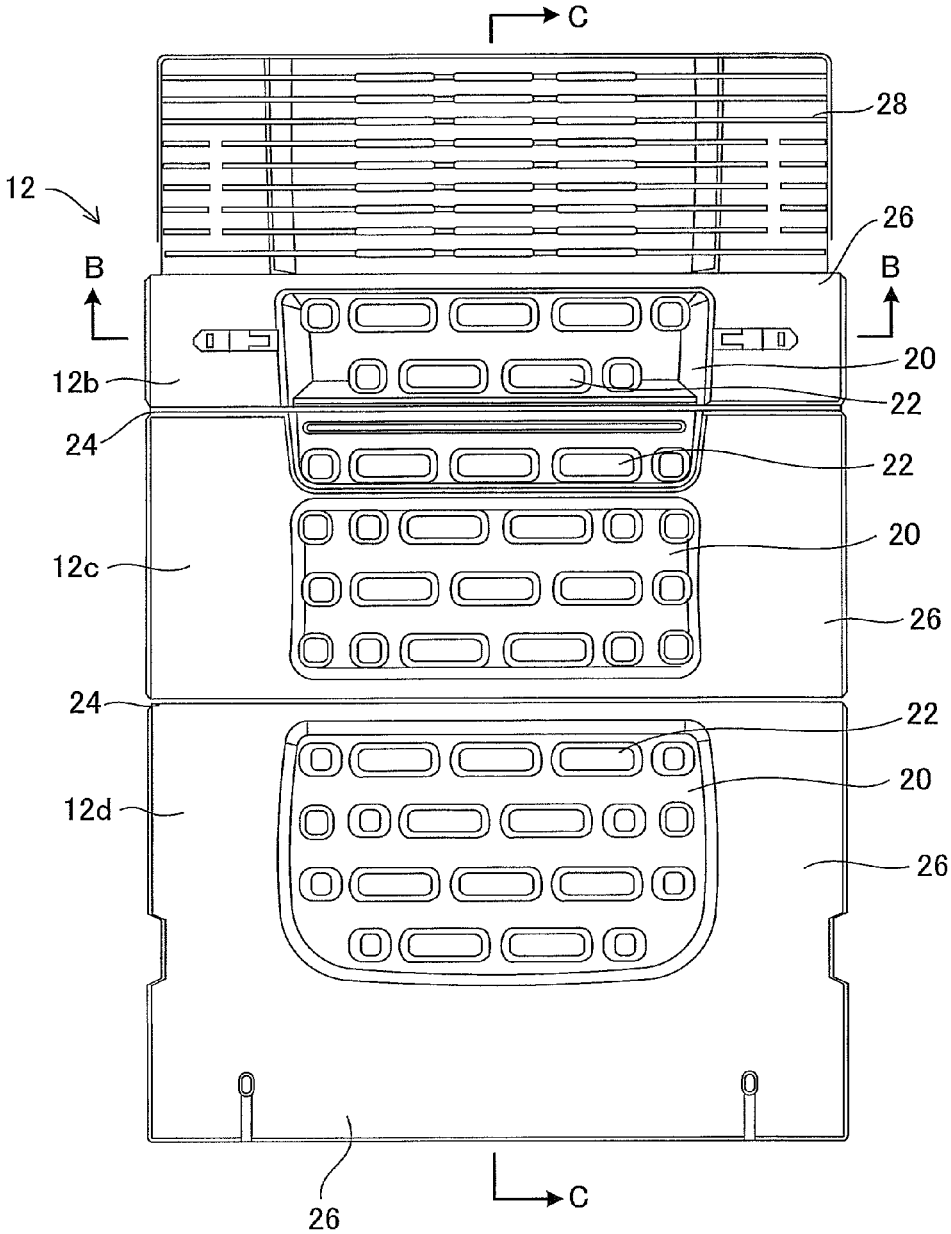
FIG. 4 (a) A plan view of essential parts of a bottom, or a hips bottom, a knee bottom and a leg bottom integrated, (b) a sectional view cut along a line B-B in (a).
Figure 4:
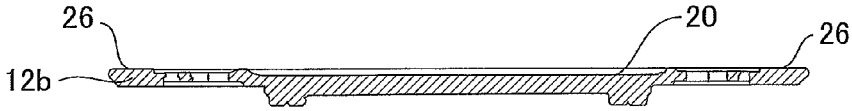

As sectionally shown in FIGS. 4(*b*) and 5, the depressed portions 20 are formed with depths equal to or smaller than half the thickness of the thick portions such as surrounding areas 26 of the back bottom 12*a*, hip bottom 12*b*, knee bottom 12*c* and foot bottom 12*d* of the bottom 12. The periphery of the depressed portion 20 contiguous from the surrounding area 26 is gently beveled with an angle of about 30 to 50 degrees with respect to the flat surface so that the user will not feel a bumpy sensation in lying in bed.

According to the bottom 12 of the bed apparatus of the embodiment, the depressed portions 20 are formed around the center in the width direction of the bottom 12, so that the pressure against the body at points of contact when the user lies on the bed apparatus is alleviated compared to the case of a flat surface. In addition, the bottom can be made breathable thanks to the passage holes 22, the user feels comfortable when lying. Since the mattress 18 on the bottom 12 sinks into the depressed portions 20, the mattress is unlikely to slip relative to the bottom 12, hence can be prevented from slipping.

Figure 3:
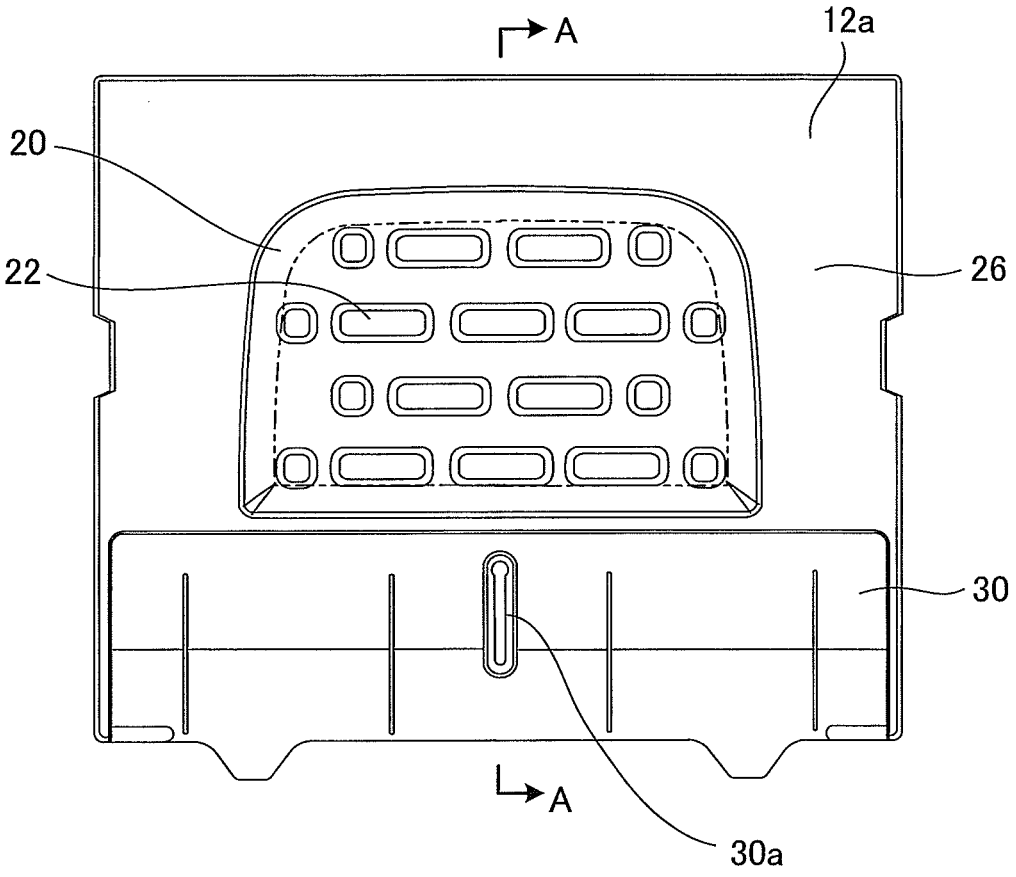
FIG. 3 A plan view of a back bottom of a bottom.

Herein, among all the parts of the bottom 12, the back bottom 12*a* is formed as a single assembly as shown in FIG. 3. As shown in FIG. 4, among all the parts, the hip bottom 12*b*, knee bottom 12*c* and foot bottom 12*d* are essential parts, which are joined by connecting parts 24, forming a single integrated assembly. The connecting parts 24 are formed of the same material with, thinner than, and integrally with, the essential parts.

A flexing bottom 28 is extended on the head side from the hip bottom 12*b* forming the aforementioned essential part, and the flexing bottom 28 flexibly joined to the back bottom 12*a* so as to slide along the back bottom 12*a*.

In this flexing bottom 28, a plurality of elongated bars each having a trapezoidal section and extended in the width direction of bottom 12, are arranged in the length direction of the bottom 12 and joined to each other by a thin part, forming an approximately slatted board-like or bellows-like flexible structure. The flexing bottom 28 is accommodated in a coupling hollow 30 of the back bottom 12*a* so as to slide in the length direction of the bottom 12 and flexibly connect to the back bottom with an unillustrated pin fitted in a slot 30*a* of the back bottom 12*a*, in a slidable manner.

Figure 5:
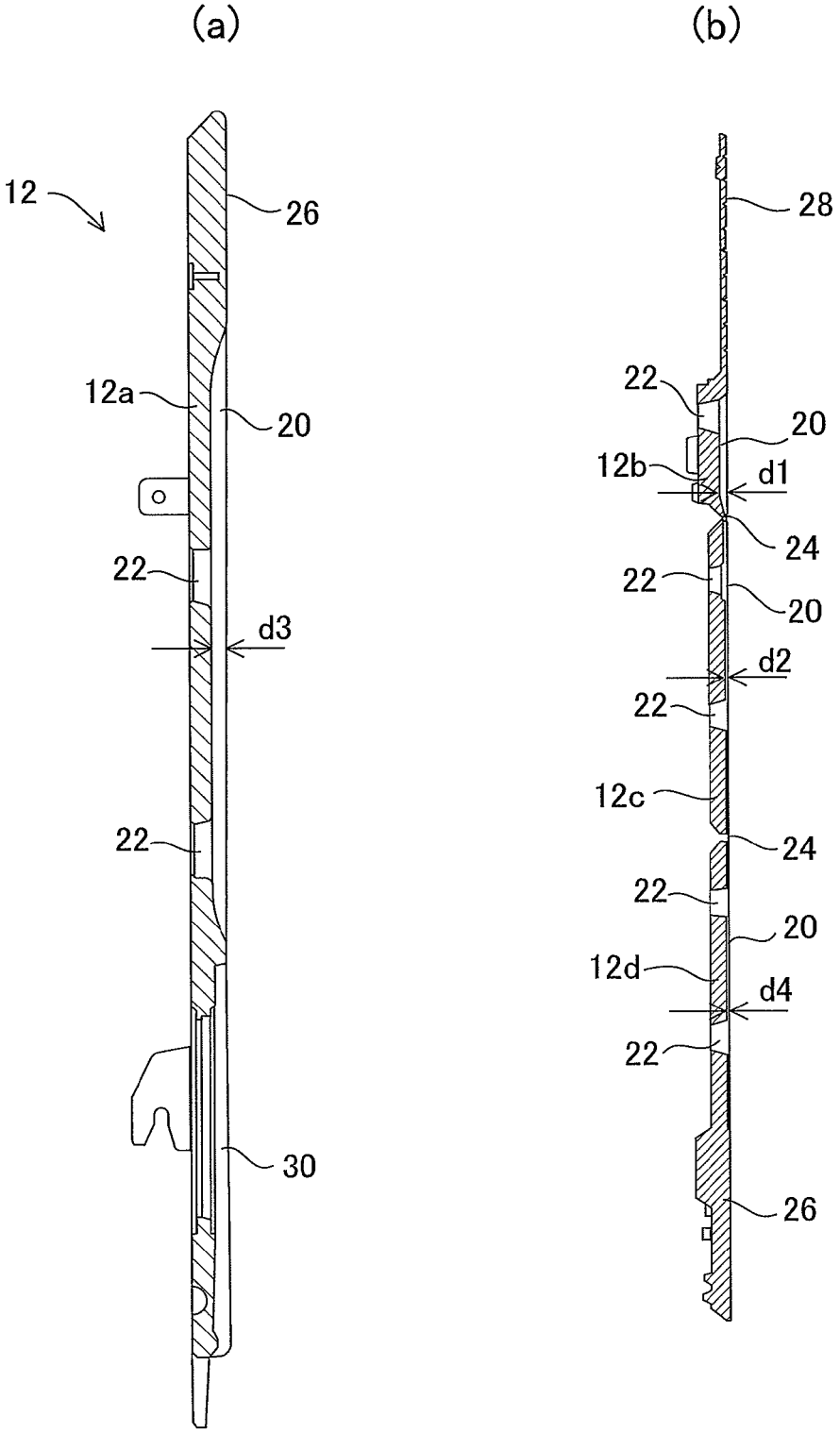
FIG. 5 (a) A sectional view cut along a line A-A in FIG. 3, and (b) a sectional view of foot-side parts, cut along a line C-C in FIG. 4(*a*).

FIG. 5(*a*) shows an enlarged section of the back bottom 12*a*, FIG. 5(*b*) a sectional view of the hip bottom 12*b*, knee bottom 12*c* and foot bottom 12*d*. FIGS. 5(*a*) and 5(*b*) are depicted in different scales, but the depressed portions 20 are formed so that the depressed portion 20 of the hip bottom 12*b* is the deepest (with a depth d1) and the depressed portion of the knee bottom 12*c* is the second deepest (with a depth d2), as shown in FIG. 5(*b*). Here, the depressed portion 20 (with a depth d3) of the back bottom 12*a* and the depressed portion 20 (with a depth d4) of the foot bottom 12*d* are formed shallower than the depressed portion 20 of the knee bottom 12*c*. The depths of the depressed portions 20 are d1>d2>d3 (or d4).

With the above configuration, when the entire bottom 12 is arranged horizontal, the hip bottom 12*b* is depressed to a certain extent so that the user's hips are held and the user's hips will not move in back-raising and feet-raising. As a result, it possible to positively prevent bending of the user's back.

INDUSTRIAL APPLICABILITY

The bottom of the bed apparatus of the present invention can be applied to the bottoms of various kinds of bed apparatus such as in-home care nursing bed apparatus, facility care nursing bed apparatus, hospital bed apparatus and the like.

DESCRIPTION OF REFERENCE NUMERALS

10 top frame
12 bottom
12*a* back bottom
12*b* hip bottom
12*c* knee bottom
12*d* foot bottom
20 depressed portion
22 passage hole
24 connecting part
26 surrounding area
28 flexing bottom

The invention claimed is:

1. A bottom for a bed apparatus, which is height adjustable and is mounted on the top of a bed apparatus, comprising:

a plurality of parts each formed of a resin plate having a thickness, including a back bottom, a hip bottom, a knee bottom and a foot bottom, wherein at least two parts among the plurality of parts are joined by connecting parts, and the connecting parts are formed of the same material with, to be thinner than, and integrally with, the resin plates forming the at least two parts, and, depressed portions are formed on the top surface of the bottom, the depressed portions are formed in the central part of the bottom with respect to the width direction, and a plurality of passage holes are formed from the top surface to the undersurface of the bottom in the depressed portions, and wherein a flexing part is extended from the hip bottom, overlapping the back bottom, and flexibly joined to the back bottom so as to slide along the back bottom when a back-raising operation is carried out.

2. The bottom for a bed apparatus according to claim 1, wherein the depressed portions are formed in dimensions corresponding to the width of the user body, leaving surrounding areas in the head side, the foot side, and both sides in the width direction, of the entire bottom.

3. The bottom for a bed apparatus according to claim 1, wherein, the depressed portions of the bottom are formed so that the depressed portion of the hip bottom is the deepest, and the depressed portion of the knee bottom is the second deepest.

4. A bottom for a bed apparatus, which is height adjustable and is mounted on the top of a bed apparatus, comprising:

a plurality of parts each formed of a resin plate having a thickness, including a back bottom and a hip bottom, wherein a flexing part is extended from the hip bottom, overlapping the back bottom, and flexibly joined to the back bottom so as to slide along the back bottom when a back-raising operation is carried out.

5. The bottom for a bed apparatus according to claim 4, wherein depressed portions are formed on the top surface of the bottom, the depressed portions are formed in the central part of the bottom with respect to the width direction, and a plurality of passage holes are formed from the top surface to the undersurface of the bottom in the depressed portions.

6. The bottom for a bed apparatus according to claim 5, wherein the depressed portions are formed in dimensions corresponding to the width of the user body, leaving surrounding areas in the head side, the foot side, and both sides in the width direction, of the entire bottom.

7. The bottom for a bed apparatus according to claim 5, wherein, the depressed portions of the bottom are formed so that the depressed portion of the hip bottom is deeper than the depressed portion of the knee bottom.

* * * * *